US010995483B1

(12) United States Patent
Sanguinetti

(10) Patent No.: US 10,995,483 B1
(45) **Date of Patent: *May 4, 2021**

(54) BERM AND FILTER SYSTEM

(71) Applicant: Peter Sanguinetti, Lodi, CA (US)

(72) Inventor: Peter Sanguinetti, Lodi, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/566,564

(22) Filed: Sep. 10, 2019

Related U.S. Application Data

(63) Continuation-in-part of application No. 16/241,051, filed on Jan. 7, 2019, now Pat. No. 10,407,891, which is a continuation of application No. 16/054,303, filed on Aug. 3, 2018, now abandoned.

(60) Provisional application No. 62/644,080, filed on Mar. 16, 2018.

(51) Int. Cl.
*E03F 5/04* (2006.01)
*E03F 5/06* (2006.01)
*E03F 1/00* (2006.01)

(52) U.S. Cl.
CPC ..... *E03F 5/0404* (2013.01); *E03F 5/06* (2013.01); *E03F 1/00* (2013.01)

(58) Field of Classification Search
CPC ..... E03F 5/0401; E03F 5/0404; E03F 5/046; E03F 5/06; E03F 5/14
USPC ..... 210/163, 164, 170.03, 747.3; 404/2, 4, 5
See application file for complete search history.

(56) References Cited

U.S. PATENT DOCUMENTS 5,405,539 A 4/1995 Schneider
5,632,888 A * 5/1997 Chinn ..... E03F 5/0404 210/163
5,788,849 A 8/1998 Hutter, Jr. et al.
5,948,250 A 9/1999 Middleton
5,954,952 A 9/1999 Strawser, Sr.
6,214,216 B1 * 4/2001 Isaacson ..... E03F 5/0404 210/163
7,074,326 B2 7/2006 Singleton
7,131,787 B2 11/2006 McGinn
(Continued)

FOREIGN PATENT DOCUMENTS

GB 2236132 A 3/1991

OTHER PUBLICATIONS http:/ertecsystems.com/Applications/Drain-Inlet-Sediment-Control/Grates-on-Hard-Surfaces.
https:/www.sohutec.com/stormdraincover.html.

*Primary Examiner* — Christopher Upton
(74) *Attorney, Agent, or Firm* — Carlos A. Fisher; Stout, Uxa & Buyan, LLP

(57) ABSTRACT

A sediment control device includes an under-seal gasket, a threshold member, a filter member, and a berm extending upwards from the top surface of the under-seal gasket. The under-seal gasket includes a first central opening, and the filter member includes a second central opening smaller than the first central opening. The threshold member and the filter member are attached directly to the bottom surface of the under-seal gasket, but are not attached to each other. The threshold member extends across the first and second central openings and includes a plurality of apertures. The berm includes an elongated cylindrical foam member that surrounds a perimeter of the first central opening, and may in some examples consist of a separate berm component comprising one or more lengths of elongated cylindrical foam members separately encased in berm sleeves, and arranged to surround the perimeter of the first central opening.

20 Claims, 8 Drawing Sheets

(56) References Cited

U.S. PATENT DOCUMENTS

| | | | | |
|---|---|---|---|---|
| 7,544,016 | B2 * | 6/2009 | McGinn | E02B 3/04 210/170.03 |
| 8,043,498 | B2 | 10/2011 | Rueda | |
| 8,051,568 | B2 | 11/2011 | Moody et al. | |
| 10,407,891 | B1 * | 9/2019 | Sanguinetti | E03F 5/0404 |
| 10,576,400 | B2 | 3/2020 | Morris | |
| 2003/0217955 | A1 * | 11/2003 | Strawser, Sr. | E03F 5/0404 210/163 |
| 2004/0112811 | A1 * | 6/2004 | Lindemulder | E03F 5/0404 210/163 |
| 2006/0127182 | A1 * | 6/2006 | Sanguinetti | E03F 5/0404 405/20 |
| 2007/0295652 | A1 * | 12/2007 | Kent | E03F 5/0404 210/164 |
| 2008/0290042 | A1 | 11/2008 | Hanson et al. | |
| 2008/0296211 | A1 | 12/2008 | Swan | |
| 2014/0048465 | A1 * | 2/2014 | D'Andreta | E03F 5/06 210/163 |
| 2017/0254063 | A1 | 9/2017 | Zock et al. | |
| 2018/0230688 | A1 | 8/2018 | Morris | |

* cited by examiner

BERM AND FILTER SYSTEM

RELATED APPLICATIONS

This application is a continuation-in part of non-provisional application Ser. No. 16/241,051, filed Jan. 7, 2019, which was a continuation of non-provisional application Ser. No. 16/054,303, filed Aug. 3, 2018, which claimed benefit of provisional application Ser. No. 62/644,080, filed Mar. 16, 2018, each of which is each individually hereby incorporated by reference in its entirety.

FIELD OF THE INVENTION

The present invention is generally directed to sediment control devices, separate berm components for use in combination with sediment control devices, and the use of such devices and device components to prevent or reduce the amount of sediment contained in liquid flow and suspension, for example from construction and roadway related repair sites, from being deposited in roadway and sidewalk drains, such as storm drains.

BACKGROUND

Storm drains, commonly located in roadways, parking lots or beside sidewalks, are ordinarily covered by a simple metal grating that supports vehicular and foot traffic at ground level, while serving the dual purposes of preventing large objects and debris from entering the drain while also providing a barrier for pedestrians and animals. Such a grating does not provide a substantial obstacle to the entry of any but the largest of debris into the drain; as a result the drain may become clogged when large volumes of debris are swept through the grating and into the drain by the liquid medium. Furthermore, the grating itself may become clogged when large materials such as fibrous materials amass and cover the opening.

Thus, where there is a potential for large amounts of sediment or debris being washed into a storm drain, such as near a construction or roadway repair site, there exists a need for additional protection and filtration to reduce the amount of debris reaching the grating any being introduced into the storm drain itself. This need is augmented by the fact that runoff water, which may contain undesirable or hazardous materials, is often directly channeled to the ocean or other public bodies of water. As a matter of general public safety and in view of environmental laws and regulation prohibiting the contamination of such resources, water entering storm drains must be free of large amounts of debris and pollutants.

Products have been developed to prevent sediment or other materials from flowing into storm drains in such situations. U.S. Pat. No. 7,481,921, granted to Kent on Jan. 27, 2009, discloses a cleanable and reusable fibrous mat adapted to filter water that is placed over the top of a preexisting grating on a storm drain. Unfortunately, storm drains are subject to variable flow rates, with very high rates being common. Although the Kent apparatus succeeds in preventing the passage of sediment and small debris that would otherwise bypass the grating, such a fibrous mat would need to be continuously cleaned and would quickly clog in high flow situations or if left untended for any significant period of time. Moreover, the Kent apparatus provides no method of filtering liquid contaminants, such as motor oil, that may commonly find their way to storm drains.

A device made by Ertec Environmental Systems, termed the GR8 Guard™, provides a flat filter device comprising an apertured polymeric inlet (threshold) member, an apertured polymeric outflow member, and a filter member secured to one or both of the threshold member and the outflow member. The perimeter of the filter sheet (i.e., about 4" inward from the perimeter of the device) is surrounded by a folded-over piece of material (such as a geotextile material) to act as a dam or barrier to prevent sediment flow from reaching the filter. However, this perimeter "fence" is not sturdy and if contacted with a strong flow of sediment-containing water, or if the filter device is run over by a motor vehicle, the dam will tend to fold down thereby becoming inoperable and defeating a major purpose of the barrier.

As such, there remains a need for a sediment control device containing, or altered to contain, a dam or berm that is sturdy enough to withstand high flow rates and vehicle traffic without buckling or collapsing.

SUMMARY

The present invention is directed to berm and filter devices, or a separate berm component structured to be fitted to a filter device, for the protection and filtration of sediment, for example during a storm or in the case of construction runoff, for the storm drain. The present invention is also drawn to methods of making or using such devices and/and or components.

In preferred examples, the present invention comprises a roadway or sidewalk grate filter for sediment control during storms or construction activities. In other examples, the present invention is directed to berm components structured to be joined to a preexisting roadway or sidewalk grate filter structured substantially as described herein.

The filter includes an under-seal gasket made of geotextile material of any desired shape, and having an opening formed therein, preferably in a central location of the under-seal gasket. In preferred examples the filter is polygonal (most preferably rectangular) in shape, and has a a first central rectangular or square opening disposed therethrough. However, those of ordinary skill in the art will recognize that the filter may be of any suitable shape for the desired use; for example, oval or circular in shape, and may have a circular or oval first central opening.

When wetted, the under-seal gasket forms a peripheral seal around the storm drain preventing water and sediment from seeping under the roadway grate filter.

The grate filter also comprises a coarsely apertured polymeric sheet (the threshold member) stapled or sewn to the gasket to cover the first, preferably central, opening of the under-seal gasket. Often all the apertures in the polymeric sheet have the same size and/or shape, though this is not necessary. The apertures can be of any shape, for example polygonal, including triangular and parallelogrammatic (including rectangular, e.g. square), round or oval. In some embodiments, each of the apertures is in the shape of a parallelogram in which the acute angles are from 60 to 82°. The area of each of the apertures (or the median area of the apertures, if they are of different sizes) can, for example, be 0.01 square inches ($in^2$) to 1.0 $in^2$, preferably 0.02 $in^2$ to 0.25 $in^2$, particularly 0.03 $in^2$ to 0.16 $in^2$, e.g. 0.04 $in^2$ to 0.1 $in^2$, and/or each of the apertures can have a minimum dimension in the range of 0.1 inches to 1.0 inches, preferably 0.15 inches to 0.5 inches, particularly 0.15 inches to 0.4 inches, e.g. 0.2 inches to 0.3 inches. Such apertures provide little or no resistance to many of the sedimentary particles generally encountered in practice, but prevent the passage of larger objects entrained by the liquid, for example sticks, rocks, fibrous material, cans and plastic bottles.

The aperture polymeric sheet is preferably composed of a polymeric composition (i.e. a composition containing a polymer and conventional additives such as fillers) which can be melt-shaped. Preferably, the composition does not absorb substantial amounts of water, can be recycled, and/or is resistant to decomposition by ultraviolet light, e.g. through the inclusion of a UV stabilizer such as a benzotriazole. Suitable polymers for the composition include polyolefins, particularly high density polyethylene and polypropylene. It is preferable to avoid the use of polymeric compositions which can decompose, or release materials harmful to the environment, including wildlife, for example polymers containing leachable plasticizers. Other materials which can be used are suitably apertured metal sheets, and interconnected metal wires, optionally coated with synthetic polymers.

The filter device also contains a sheet-like filter member having a second, preferably central, opening; in preferred examples the second opening is a rectangular or square opening, smaller than the first opening of the under-gasket seal, defined therein. The filter member is affixed to to the under-seal gasket, thereby covering the periphery of the threshold member. Very preferably the filter member is not secured to the threshold member.

Still further, the filter device includes a raised sediment berm at least partially surrounding the perimeter of the first opening. The berm may be shaped or joined to the filter so as to form a sediment dam on one or more side of the first opening. In some examples the berm comprises a separate berm component, or a plurality of separate berm components structured to be fastened to a top surface of the filter device.

In preferred rectangular filters the sediment berm surrounds the first central rectangular or square opening. The sediment berm is very preferably made using a polymeric foam (such as at least 1 inches in height or 1.25 inches in height, or 1.5 in height foam rubber) encased in a geotextile sleeve. When the filter is rectangular in shape the berm forms, or may be joined to the filter to form, a rectangular or square perimeter on a top side of the under-seal gasket around the polymeric sheet and filter member. Preferably, although not necessarily, the polymeric foam is cylindrical in shape and has a diameter of at least 1 inches, or at least 1.25 inches, or at least about 1.5 inches. The foam polymer may be any suitable elastomeric polymer, such as a polyurethane, a polyethylene polymer, a natural latex, and the like. Very preferably the geotextile sleeve is made so that the foam polymer may be replaced as needed.

The sediment berm may be formed as a separate berm component from the filter device and joined to the top side of the filter device in any suitable way, for example by sewing, stapling, or through the use of hook and loop type fasteners joined to the berm and the top surface of the filter device, for example, the top surface of the under-seal gasket. Thus, in some examples the present invention is directed to one or more separate sediment berm component structured to be joined to the top side of a filter device and wholly or partially surrounding the first, preferably central, opening. In some examples separate sediment berm components may be ready-made to possess a hook or loop portion of a hook and loop fastener pre-attached (for example, by sewing, stapling, gluing and the like) thereto. This portion may then be joined to the complementary portion which is joined or affixed to the top side the the under-seal gasket of the filter device. In other examples the separate sediment berm components may be joined or fastened to a top surface of the filter device by any suitabler means, such as by sewing, stapling, gluing, hot melt or other fastening means.

Alternatively, the sediment berm may be formed by joining folds of material of the top side of under-seal gasket around the foam to form a tube encasing the foam strips or cylinders therewithin.

Very preferably, the filter device does not comprise a second apertured polymeric sheet (e.g., an outflow member).

An advantage of having the polymeric sheet and filter member each separately joined to the gasket (and not to each other) is that each one of these components may be replaced, cleaned and/or serviced as needed without disassembling the entire filter device or needing to discard the filter device and purchasing another.

Another advantage of the present invention is that the inherent resiliency of the cylindrical foam berm permits the filter device to be run over by automobile traffic without permanently damaging the berm of the device. The foam resumes its original shape after being crushed and continues to serve its purpose to block all but high-volume flow from reaching the filter. The berm is thus the first line of defense to protect the drain inlet from sediment and debris entering the drain. During a higher volume rain event, storm water will breach the berm, carrying sediment (usually carrying smaller, more lightweight suspended materials) that will flow onto the filter member, which will then act as a second line of defense. The second central opening, in the filter member of the filter device, permits flow of water into the drain during particularly heavy fluid flows (such as heavy rainfall during a storm) to prevent backup, blocking, and/or possible flooding.

Preferably, the under-seal gasket material is made from 16 ounce non-woven geotextile material (e.g., FX®-120HS Carthage Mills, 4243 Hunt Road Cincinnati, Ohio 45242). A seal is created when the material is permeated with water, thereby adhering it to the concrete or asphalt. Geotextiles are permeable fabrics which, when used in association with soil, have the ability to separate, filter, reinforce, protect, or drain. Typically made from polypropylene or polyester, non-woven geotextile material is very similar in texture to common felt.

Preferably the filter sheet is a woven filtration polymer made of high-tenacity, monofilament polypropylene yarns which are woven into a stable network such that they retain their relative position. One preferred example is Carthage 15% filter material, having an apparent pore size of 0.425 mm; Carthage Mills, 4243 Hunt Road Cincinnati, Ohio 45242). Those of ordinary skill recognize that one may choose a particular filter or filter pore size to fit the environment and surrounding soil.

Preferably, the foam berm sleeve or cover is made from 12 ounce non-woven geotextile material (e.g., FX®-80HS Carthage Mills, 4243 Hunt Road Cincinnati, Ohio 45242).

In a currently preferred embodiment, the apertured polymeric sheet component has a minimum aperture dimension of about ⅛ inch, and is made of perforated high-density polyethylene (HDPE).

The foam berm may be removed and replaced when needed without replacing the entire filter device. The apertured polymeric member may optionally be present or absent.

Very preferably, the present invention does not comprise a folding line (or score) of thinner or thicker material for shaping the flat filter device described herein into other three-dimensional shapes, such as an L-shape.

The preferred method of affixing the filter to the grate is by attaching strong wire, such as baling or rebar wire, to four corners of the storm drain inlet grate, feed the wire through the filter and 'lock' the filter into place by twisting the wire a few times and cutting off the excess.

In one embodiment of the present invention, a sediment control device includes an under-seal gasket is rectangular in shape, having a top surface, a bottom surface, a first length, and a first width. A first central opening in the under-seal gasket has a second length and a second width. The sediment control device further includes a threshold member having a top surface, a bottom surface, a third length, and a third width. The third length and third width are, respectively, greater than the second length and second width. The top surface of the threshold member is preferably attached directly to the bottom surface of the under-seal gasket. The threshold member extends across the first central opening. The threshold member may be a polymeric sheet having apertures. The threshold member may be perforated high density polyethylene. The threshold member may be a single polymeric sheet having a plurality of apertures. The threshold member may be a non-laminar polymeric sheet. By laminar is meant that sheets of material are layered one on another, and that at least one surface of a sheet in the laminar material is directly joined to another sheet in the laminar material.

Still further, the sediment control device includes a filter member having a top surface, a bottom surface, a fourth length, and a fourth width. The top surface of the filter member is preferably attached directly to the bottom surface of the under-seal gasket. When in place the top surface of the filter member is in contact with, but not secured to, the bottom surface of the threshold member. On one embodiment the fourth length and fourth width are, respectively, greater than the second and third lengths and widths. In another embodiment the fourth length and fourth width are larger than the second width and second length, but less than the third width and third length.

The sediment control device further includes a second central opening in the filter member, the second opening having a fifth length and a fifth width, wherein the fifth length is smaller than the first, second, third, and fourth lengths, and the fifth width is smaller than the first, second, third, and fourth widths. The under-seal gasket, first central opening, threshold member, filter member, and second central opening may be square or rectangular.

A foam polymer berm is joined to the top surface of the under-seal gasket. In a preferred embodiment the berm includes an elongated cylindrical foam member that surrounds a perimeter of the first central opening. In this embodiment the elongated cylindrical foam member may be covered with an upper skirt that is attached directly to the top surface of the under-seal gasket. The threshold member preferably includes outer edges surrounding a central portion that covers the first central opening, and the outer edges of the threshold member may be disposed between the upper skirt and the under-seal gasket.

In some uses the sediment control device may further include an additional flap of apertured polymeric material configured for being folded upwards relative to the under-seal gasket and for covering an opening in a curb adjacent to a drain over which the sediment control device is positioned. Preferably, the additional flap of apertured polymeric material is removably connected to the sediment control device, such as with hook and loop (e.g., VELCRO™) type connectors, and can be arranged at right angles to the plane of the remainder of the sediment control device.

Another embodiment of the present invention is directed to a sediment control device that includes an under-seal gasket having a top surface, a bottom surface, and a first central opening. The sediment control device further includes a threshold member attached directly to the bottom surface of the under-seal gasket and extending across the first central opening. The threshold member has a plurality of apertures. Still further, the sediment control device includes a filter member attached directly to the bottom surface of the under-seal gasket and having a second central opening smaller than the first central opening. A first portion of an upper surface of the filter member may be in direct contact with the bottom surface of the under-seal gasket, and a second portion of the upper surface of the filter member may be in direct contact with a bottom surface of the threshold member.

A berm extends upwards from the top surface of the under-seal gasket. The berm includes an elongated cylindrical foam member that surrounds a perimeter of the first central opening. The cylindrical foam member may be enclosed in an upper skirt, and the upper skirt may be attached directly to the top surface of the under-seal gasket. The threshold member may include outer edges surrounding a central portion that extends across the first central opening, and the outer edges of the threshold member may be sandwiched between the upper skirt and the under-seal gasket.

Another example of the present invention is directed to a sediment control device that includes an under-seal gasket having a top surface, a bottom surface, and a first central opening. The sediment control device further includes a threshold member attached directly to the bottom surface of the under-seal gasket and extending across the first central opening. The threshold member has a plurality of apertures. Still further, the sediment control device includes a filter member attached directly to the bottom surface of the under-seal gasket and having a second central opening smaller than the first central opening. A first portion of an upper surface of the filter member may be in direct contact with the bottom surface of the under-seal gasket, and a second portion of the upper surface of the filter member may be in direct contact with a bottom surface of the threshold member.

A separate sediment berm component comprises a cylindrical foam member encased within a tube of geotextile material, and comprising hook or loop portions of a hook and loop fastener (such as the VELCRO® hook and loop fasteners made by the 3M Company) joined to the outer surface thereof. This separate sediment berm component may be made and sold as a separate product for use in conjunction with a filter device, or may be a separate part included with a filter device.

In use, the hook or loop portions attached to the sediment berm component are preferably mated with complementary hook or loop portions joined to the top surface of the under-seal gasket in a manner permitting the berm to wholly or partially surround a perimeter of the first central opening. The separate sediment berm components may comprise separate lengths of the encased foam, which are arranged as straight segments around the perimeter of the first central opening to form a rectangle surrounding the first central opening and joined to the top side of the under-seal gasket. Alternatively, the separate sediment berm components may comprise a single length of encased foam, which is then shaped around the central opening and joined using fasteners to the top side of the under-seal gasket. Although hook and loop fasteners are used to joined the berm to the filter device in this example, one of ordinary skill in the art will immediately recognize that the separate sediment berm components may be joined to the filter in any other suitable way; for example, by use of snap or buckle fasteners, sewing, stapling or gluing.

The threshold member may include outer edges surrounding a central portion that extends across the first central opening, and the outer edges of the threshold member may be sandwiched between the upper skirt and the under-seal gasket.

BRIEF DESCRIPTION OF THE DRAWINGS

The foregoing and other aspects of embodiments are described in further detail with reference to the accompanying drawings, wherein like reference numerals refer to like elements and the description for like elements shall be applicable for all described embodiments wherever relevant.

DETAILED DESCRIPTION

Figure 1:
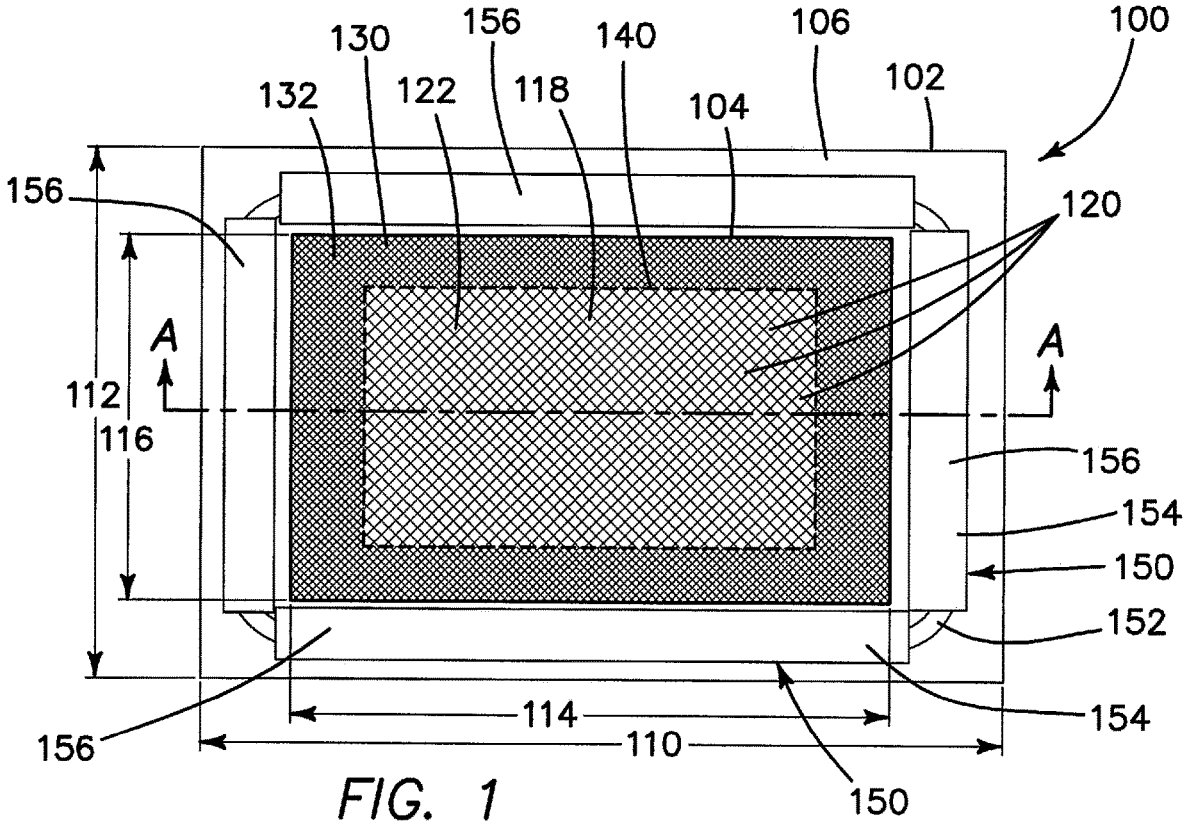
FIG. 1 is a plan view of the top surface of the sediment control device in accordance with the present invention.
Figure 2:
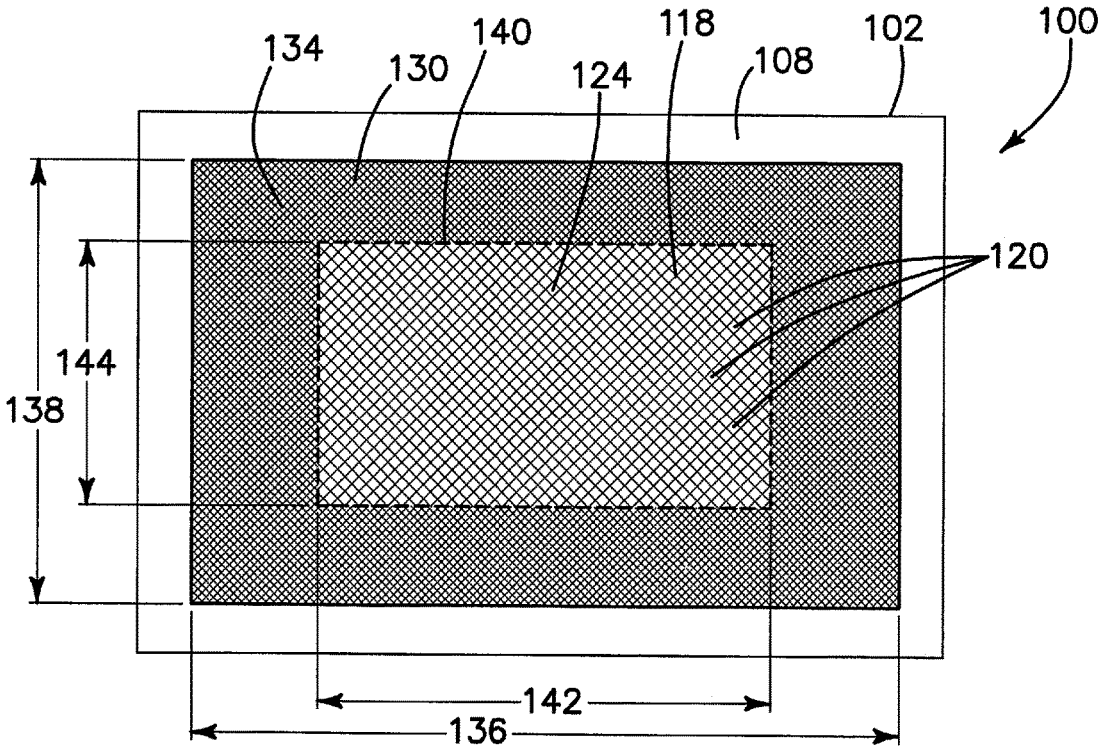
FIG. 2 is a plan view of the bottom surface of the sediment control device.

Disclosed herein is a sediment control device that includes a raised, preferably cylindrical, polymeric foam berm around its perimeter. Although the polymeric foam berm is preferably cylindrical, in other embodiments the foam berm may have another shape, such as a rectangle or triangle, in cross-section. The sediment control device further comprises an under-seal gasket, an apertured threshold member, and a filter member. The threshold member and the filter member are attached directly to the under-seal gasket for easy removal and replacement if necessary. Preferably the threshold member and the filter member are not elements of a laminar sheet. The threshold member is a single, non-laminar sheet of polymeric material comprising a plurality of apertures.

Also disclosed herein is a separate sediment berm component comprising an elongated foam member encased within a berm sleeve of geotextile material. Preferably the elongated foam member is a foamed elastomeric material such as polyurethane, polyethylene, natural latex or the like that can withstand repeated compression, such as that due to vehicle traffic or high liquid flow rates, without buckling or collapsing. The geotextile material of the berm sleeve is preferably sewn around the elongated foam member. The separate sediment berm component may be joined to the top side of the under-seal gasket or upper skirt of the filter device in any suitable way, for example and without limitation, by sewing; through the use of berm-retaining loops arranged around the first central opening on the top surface of the under seal gasket; by stapling; or through the use of fasteners such as snap fasteners, buckle fasteners, and/or hook and loop fasteners (e.g., the VELCRO® hook and loop fasteners made by the 3M Company). In some examples complementary mating components of such fasteners are joined to and aligned respectively on the outside surface of the separate berm component and the under-seal gasket. In other embodiments the material of the underseal gasket and/or the geotextile material of the separate sediment berm component may be suitable in and of itself for use as a "loop" fastener, and the hook portion of the fastener may be placed on the other component (berm or gasket, as suitable) for joining directly to the geotextile material. The elongated foam member may have any suitable cross-sectional shape (e.g., triangular, square or rectangular, etc.) but is preferably cylindrical in shape.

This separate sediment berm component may be made and sold as a stand-alone product for use in conjunction with any suitable filter device, or may be a separate part fastened to a sediment filter device.

In one example the sediment control device 100 is described in more detail with reference to FIGS. 1-4. The sediment control device of this example 100 includes an under-seal gasket 102 having a large central opening 104, a top surface 106, a bottom surface 108, a length 110, and a width 112. The central opening 104 has a length 114 and a width 116. When the sediment control device 100 is installed over a drain, the under-seal gasket 102 contacts the road surface that surrounds the drain and forms a peripheral seal around the storm drain when wetted, thus preventing water from seeping under the sediment control device 100. Although the under-seal gasket 102 and the opening 104 are depicted as being rectangular, one of ordinary skill in the art would readily understand that the gasket 102 and/or the opening 104 may be square, or any other suitable shape in other examples. The size and shape of the sediment control device 100 may be customized to fit the size and shape of the grate over which it is to be installed. The under-seal gasket 102 may be made from a geotextile material. Non-woven geotextile material is very similar in texture to common felt. For example, the under-seal gasket 102 may be 12 ounce or 16 ounce non-woven geotextile material (e.g., non-woven geotextiles manufactured by Carthage Mills, such as FX®-120HS or FX®-160HS Carthage Mills, 4243 Hunt Road Cincinnati, Ohio 45242). A seal is created when the material of the under-seal gasket 102 is permeated with water, thereby adhering it the concrete or asphalt that surrounds the drain. The under-seal gasket 102 may be formed of a single, unitary piece of material with the central opening 104 cut out of the material. Alternatively, the under-seal gasket 102 may be formed of four strips of material attached together to surround the central opening 104.

Extending across the central opening 104 in the under-seal gasket 102 is a threshold member 118. The threshold member 118 may be a single, non-laminar sheet of perforated high-density polyethylene (HDPE) having a plurality of apertures 120. In other, less preferred, embodiments the threshold member may comprise an apertured metal sheet or grid of interconnected wires. The sediment control device 100 does not include an outflow member or a laminar sheet of any sort covering the central opening 104. The apertures 120 are sized and shaped to prevent large debris (e.g., large stones, twigs, or the like) from entering the drain while also allowing liquid and sediment to flow therethrough to avoid clogging and runoff. As such, the size of the apertures 120 may be approximately 0.05-0.5 inches, or 0.1-0.2 inches, or ⅛ inch. The threshold member 118 has a top surface 122, a bottom surface 124, a length 126 (shown in FIG. 4), and a width 128 (shown in FIG. 4). The length 126 and width 128 of the threshold member 118 are, very preferably, respectively less than the length 110 and width 112 of the under-seal gasket 102 and greater than the length 114 and width 116 of the opening 104 in the under-seal gasket 102.

The sediment control device of this example 100 further includes a filter member 130 having a top surface 132, a bottom surface 134, a length 136, a width 138, and a central opening 140 that is smaller than the central opening 104 in the under-seal gasket 102. The length 136 and width 138 of the filter member 130 are, respectively, smaller than the length 110 and width 112 of the under-seal gasket 102. The length 136 and width 138 of the filter member 130 are, as shown, respectively larger than the length 126 and width 128 of the threshold member 118 and larger than the length 114 and width 116 of the opening 104 in the under-seal gasket 102. In alternative embodiments (discussed below), the length 136 and width 138 of the filter member 130 may be, respectively, smaller than the length 126 and width 128 of the threshold member 118. The length 142 and width 144 of the central opening 140 in the filter member 130 are, respectively, smaller than the length 114 and width 116 of the opening 104 in the under-seal gasket 102. The filter member 130 may be formed of a single, unitary piece of material with the central opening 140 cut out of the material. Alternatively, the filter member 130 may be formed of a plurality of (for example, four) strips of material attached together to surround the central opening 140. Preferably the filter member 130 is a woven filtration geotextile made of high-tenacity, monofilament polypropylene yarns which are woven into a stable network such that they retain their relative position. (e.g., Carthage 15%; apparent pore size 0.425 mm; Carthage Mills, 4243 Hunt Road Cincinnati, Ohio 45242).

Each of the threshold member 118 and the filter member 130 are attached directly to the under-seal gasket 102. Notably, the threshold member 118 and the filter member 130 are not attached to each other. This arrangement allows for easy removal and replacement of the threshold member 118 and the filter member 130.

Figure 4:
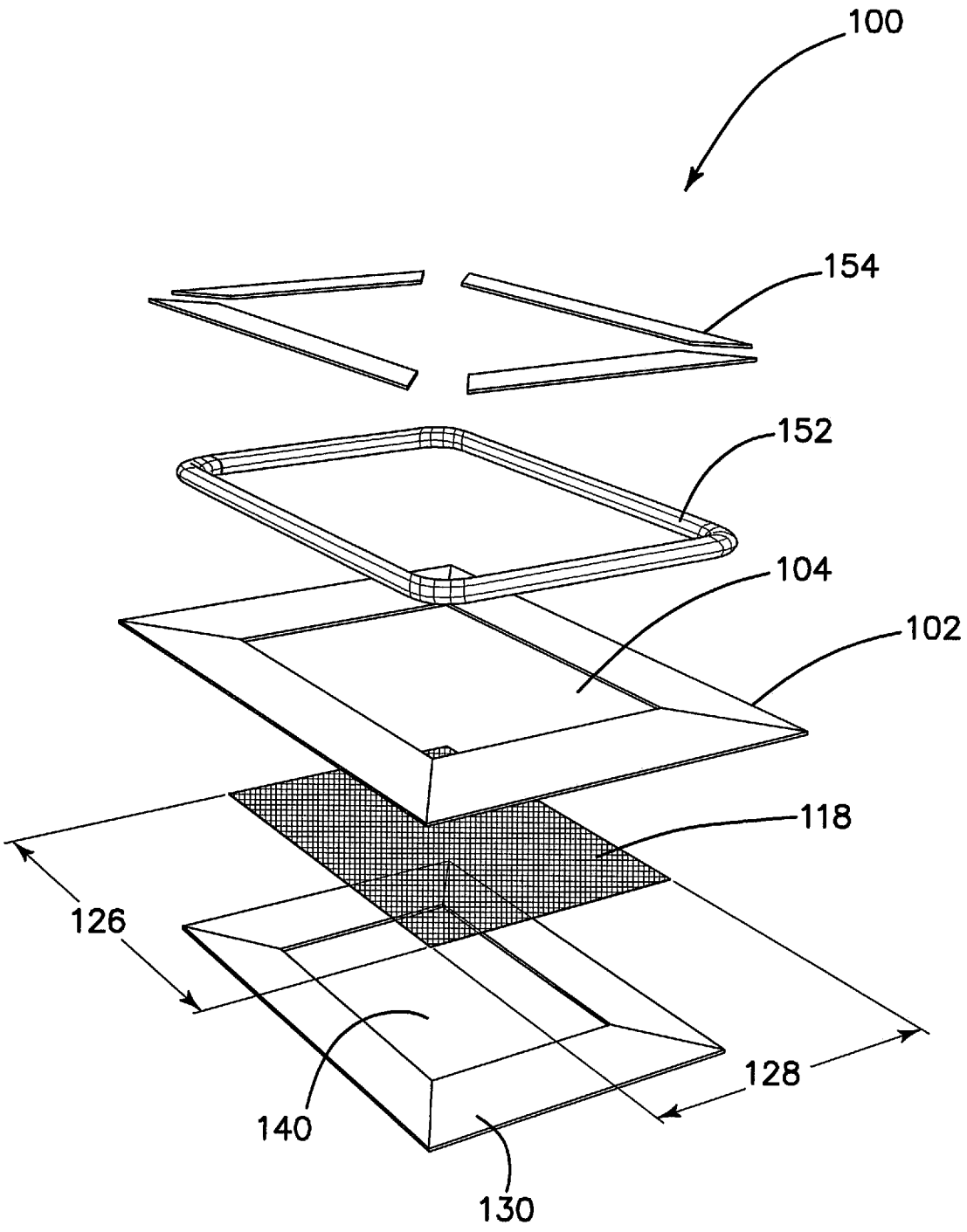
FIG. 4 is an exploded view of one embodiment of the sediment control device.

The sediment control device 100 further includes a berm 150 that comprises a foam insert 152 (in this case, cylindrical in shape) covered by a fabric upper skirt 154. While the foam insert 152 may have any desired diameter, depending upon the desired height of the berm 150, in this embodiment the elongated foam cylinder 152 is very preferably between 1 and 2 inches in diameter. In particular, the foam cylinder 152 may preferably be 1.5 inches in diameter. The foam cylinder 152 is formed of a resilient material (e.g., a foamed elastomeric material such as polyurethane, polyethylene, natural latex or the like) that can withstand repeated compression, such as that due to vehicle traffic or high liquid flow rates, without buckling or collapsing. The cylindrical foam insert 152 is covered and enclosed by the upper skirt 154, which may be formed of a material similar to, or the same as, the material that forms the under-seal gasket 102. For example, the upper skirt 154 may be a non-woven geotextile material, such as the non-woven geotextile materials manufactured by Carthage Mills (e.g., FX®-80HS, FX®-120HS, or FX®-160HS, Carthage Mills, 4243 Hunt Road Cincinnati, Ohio 45242). The upper skirt 154 may be attached directly to the under-seal gasket 102. The upper skirt 154 may be a single, unitary piece having a length and width that are, respectively, smaller than the length 110 and width 112 of the under-seal gasket 102 but larger than the length 114 and width 116 of the opening 104. Alternatively, the upper skirt 154 may include four strips of material 156 that are attached to each other and to the under-seal gasket 102, as depicted in FIGS. 1 and 4. The berm 150 is thus configured to be the first line of defense to protect the drain inlet from large amounts of sediment and debris entering the drain. During a higher volume rain event, storm water will breach the berm 150, carrying sediment that will flow onto the filter member 130, which will then act as a second line of defense. The central opening 140 in the filter member 130 permits flow into the drain during particularly heavy flows to prevent backup, blocking, and/or possible flooding.

Figure 3A:
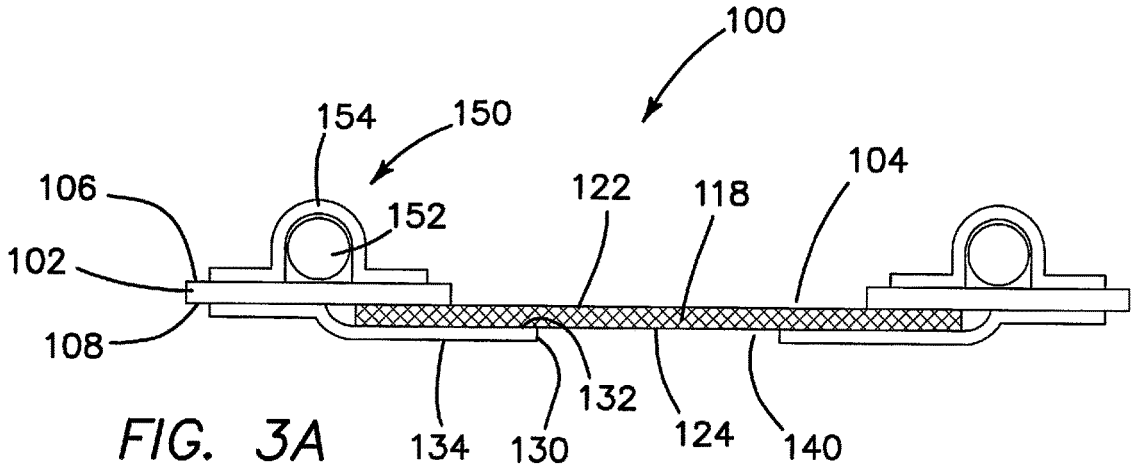
FIG. 3A is a cross-sectional view of the sediment control device taken along line A-A in FIG. 1 in accordance with one embodiment of the present invention.
Figure 3B:
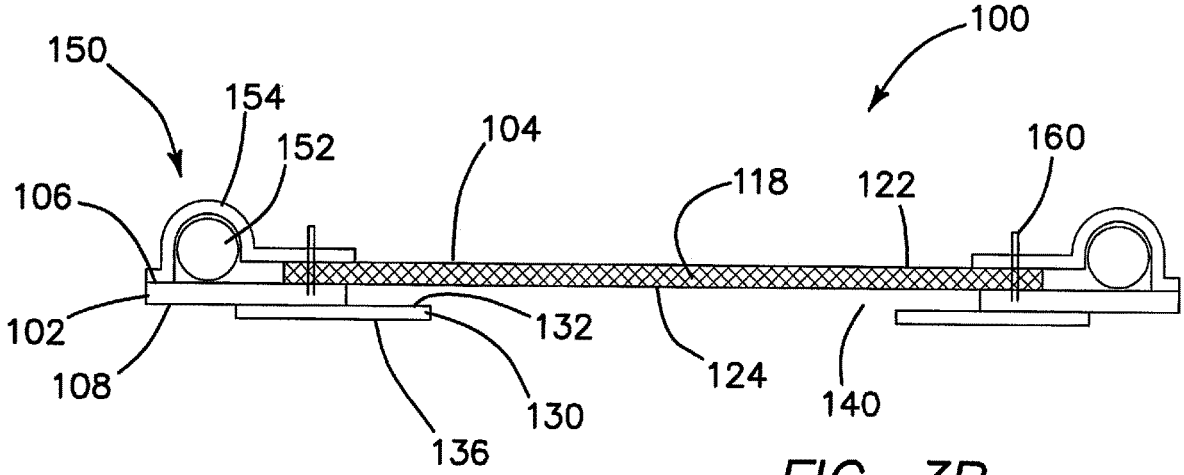
FIG. 3B is a cross-sectional view of the sediment control device taken along line A-A in FIG. 1 in accordance with another embodiment of the present invention.

In one example, shown in FIG. 3B, the threshold member 118 is sandwiched between the under-seal gasket 102 and the upper skirt 154. The outer edges of the upper surface 122 of the threshold member 118 are in direct contact with the upper skirt 154, and the outer edges of the lower surface 124 of the threshold member 118 are in direct contact with the top surface 106 of the under-seal gasket 102. The upper skirt 154, threshold member 118, and under-seal gasket 102 are attached together with a plurality of staples 160. However, one of ordinary skill in the art would readily understand that any other attachment means (such as stitching, adhesive, melt bonding or the like) may be used. The filter member 130 is attached directly to the bottom surface 108 of the under-seal gasket 102 without the threshold member 118 disposed therebetween. Although the filter member 130 is depicted having a length 136 and width 134 that are greater, respectively, than the length 126 and width 128 of the threshold member 118, the length 136 and width 138 of the filter member 130 may alternatively be smaller than the length 126 and width 128 of the threshold member 118 in this example since the filter member 130 and the threshold member 118 are positioned on opposite sides of the under-seal gasket 102.

In another example, shown in FIG. 3A, the threshold member 118 is disposed under the under-seal gasket 102, such that the outer edges of the upper surface 122 of the threshold member 118 are in direct contact with the bottom surface 108 of the under-seal gasket 102.

In both examples, the filter member 130 is disposed below the under-seal gasket 102, the threshold member 118, and the berm 150. The filter member 130 is attached directly to the under-seal gasket 102. The outer edges of the upper surface 132 of the filter member 130 are in direct contact with the bottom surface 108 of the under-seal gasket 102. The inner edges of the upper surface 132 of the filter member 130 are in direct contact with the threshold member 118 but are not attached to the threshold member 118. As such, the filter member 130 is larger than the threshold member 118. That is, the length 136 and width 138 of the filter member 130 are, respectively, larger than the length 126 and width 128 of the threshold member 118. The filter member 130 is preferably attached to the under-seal gasket 102 by stitching, but it should be readily understood that any other attachment means (such as staples, adhesive, or the like) may be used without departing from the scope of the present invention.

Figure 5:
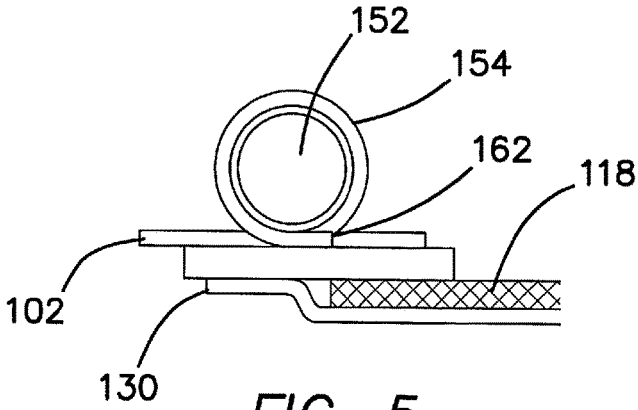
FIG. 5 is a cross-sectional view of the berm of the sediment control device in accordance with yet another embodiment of the present invention.

The upper skirt 154 is depicted in FIGS. 3A and 3B as being draped over the elongated cylindrical foam insert 152. In another embodiment, depicted in FIG. 5, the upper skirt 154 forms a pocket into which the foam insert 152 is placed. The fabric of the upper skirt 154 encircles the foam cylinder 152 and is attached to itself at 162, such as by sewing, stapling, or the like. In this manner, the upper skirt 154 substantially encloses the entire outer surface of the foam insert 152.

Figure 6:
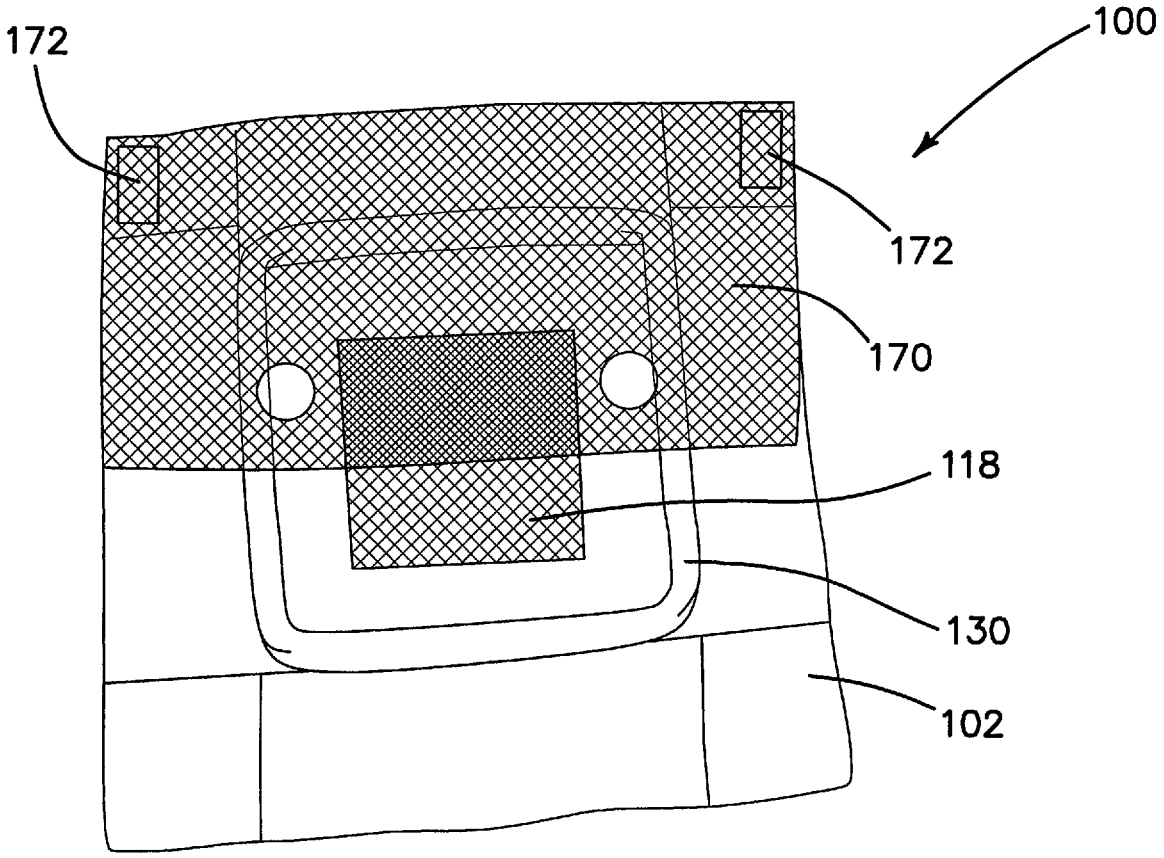
FIG. 6 is a bottom plan view of the sediment control device in accordance with still another embodiment of the present invention.
Figure 7:
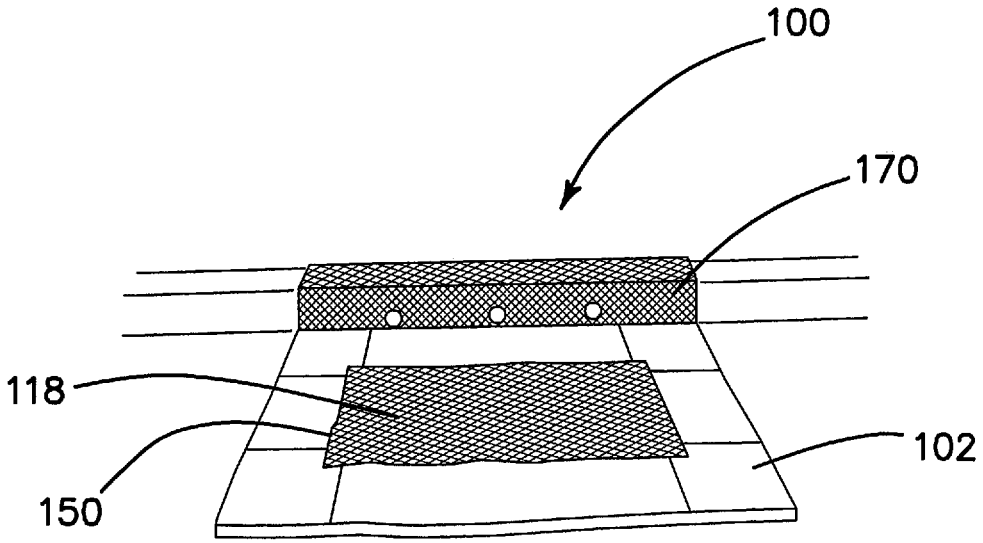
FIG. 7 is a perspective view of the sediment control device installed over a grate in the roadway.

As shown in FIG. 6, the sediment control device 100 may further include an additional flap 170 of apertured polymeric material for covering a vertical opening as well as the grate, such as a sidewalk type drain opening. The additional flap 170 is removably attached to the under-seal gasket 102 by fasteners 172, which may be hook and loop type (e.g., VELCRO®) fasteners, or the like. In this manner, the additional flap 170 may be easily removed from the device 100 if it is not needed. If the additional flap 170 is needed, it may simply be folded up to cover the sidewalk opening, as shown in FIG. 7. Very preferably, the present invention does not comprise a folding line (or score) of thinner or thicker material for shaping the flat sediment control device 100 into other three-dimensional shapes, such as an L-shape.

The preferred method of affixing the sediment control device 100 to the grate is by attaching strong wire, such as baling or rebar wire, to four corners of the storm drain inlet grate, feed the wire through the sediment control device 100 (e.g., through the apertures 120 in the threshold member 118) and 'lock' the sediment control device 100 into place by twisting the wire a few times and cutting off the excess.

Figure 8:
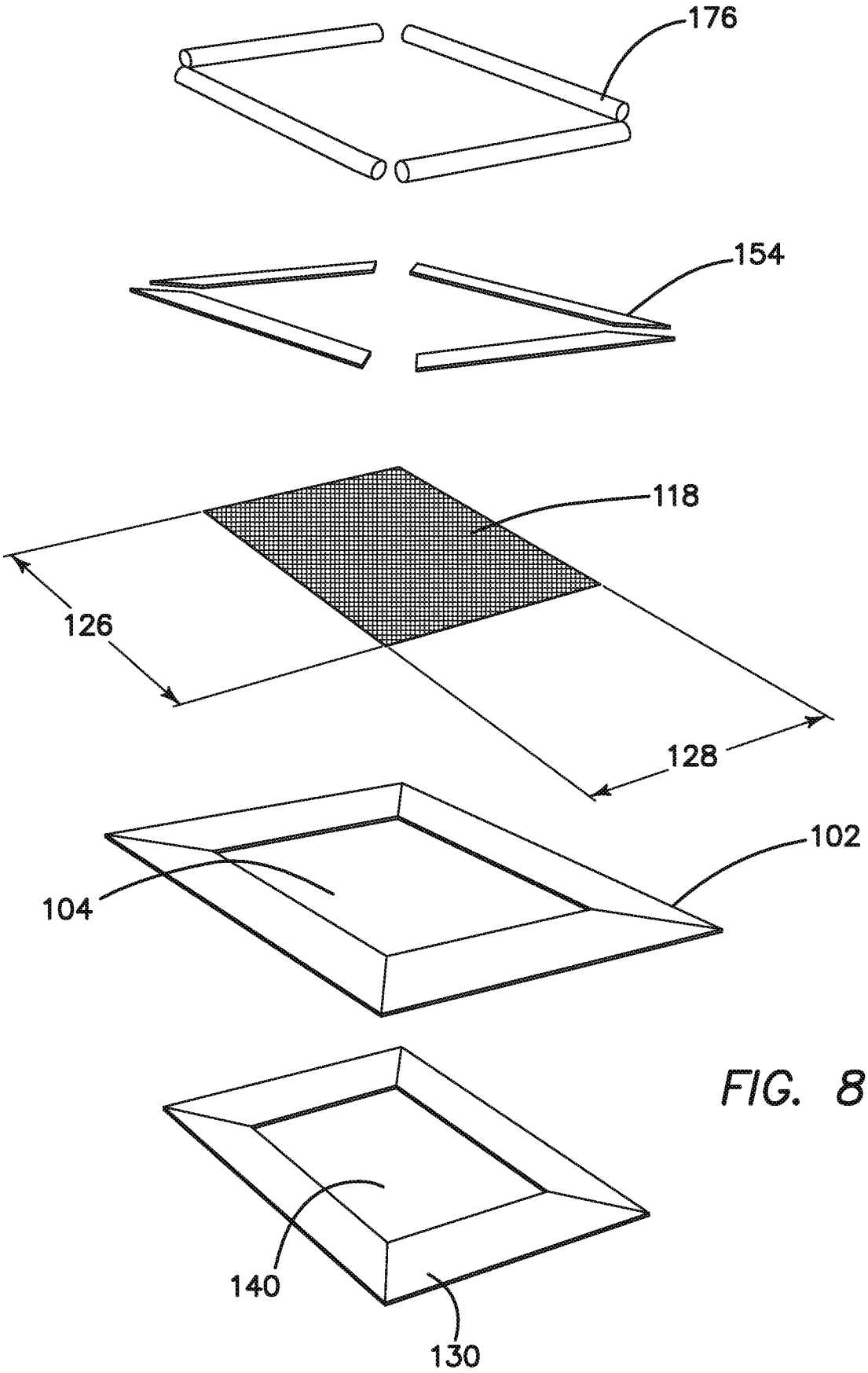
FIG. 8 is an exploded view of another embodiment of the invention.
Figure 10A:
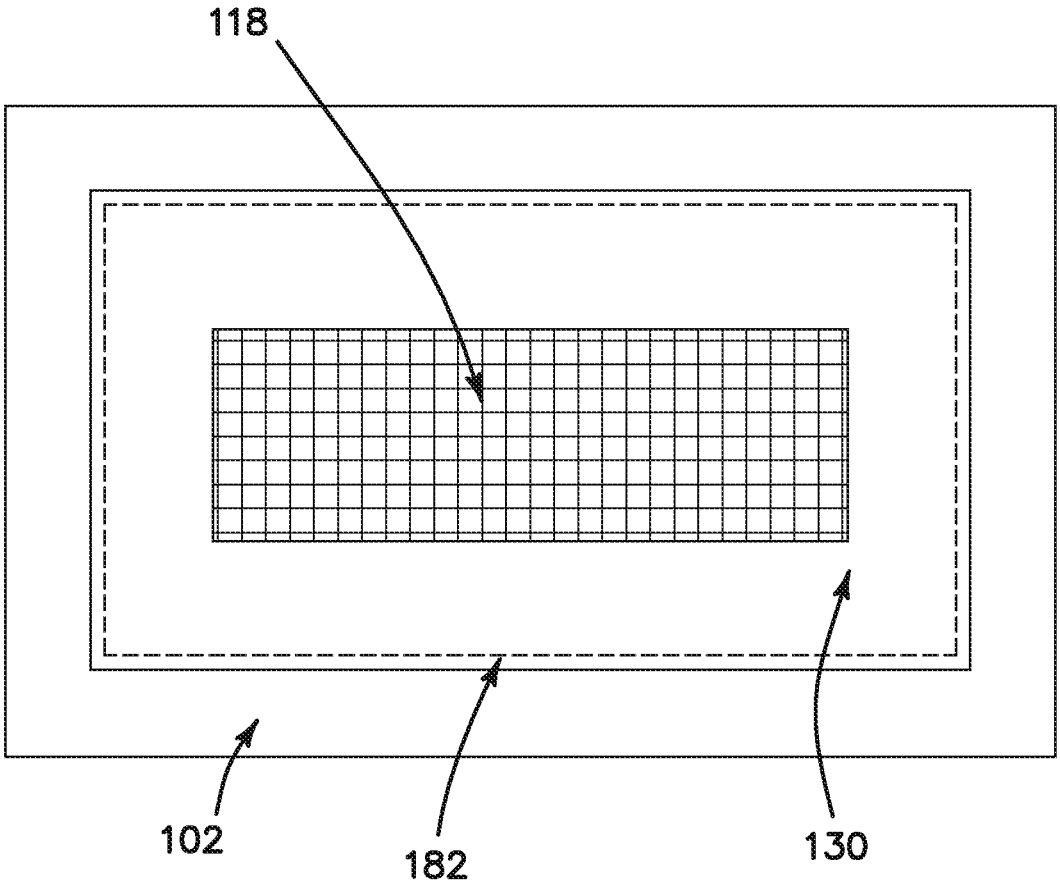
FIG. 10A is a bottom view of a filter device of the present invention.
Figure 11A:
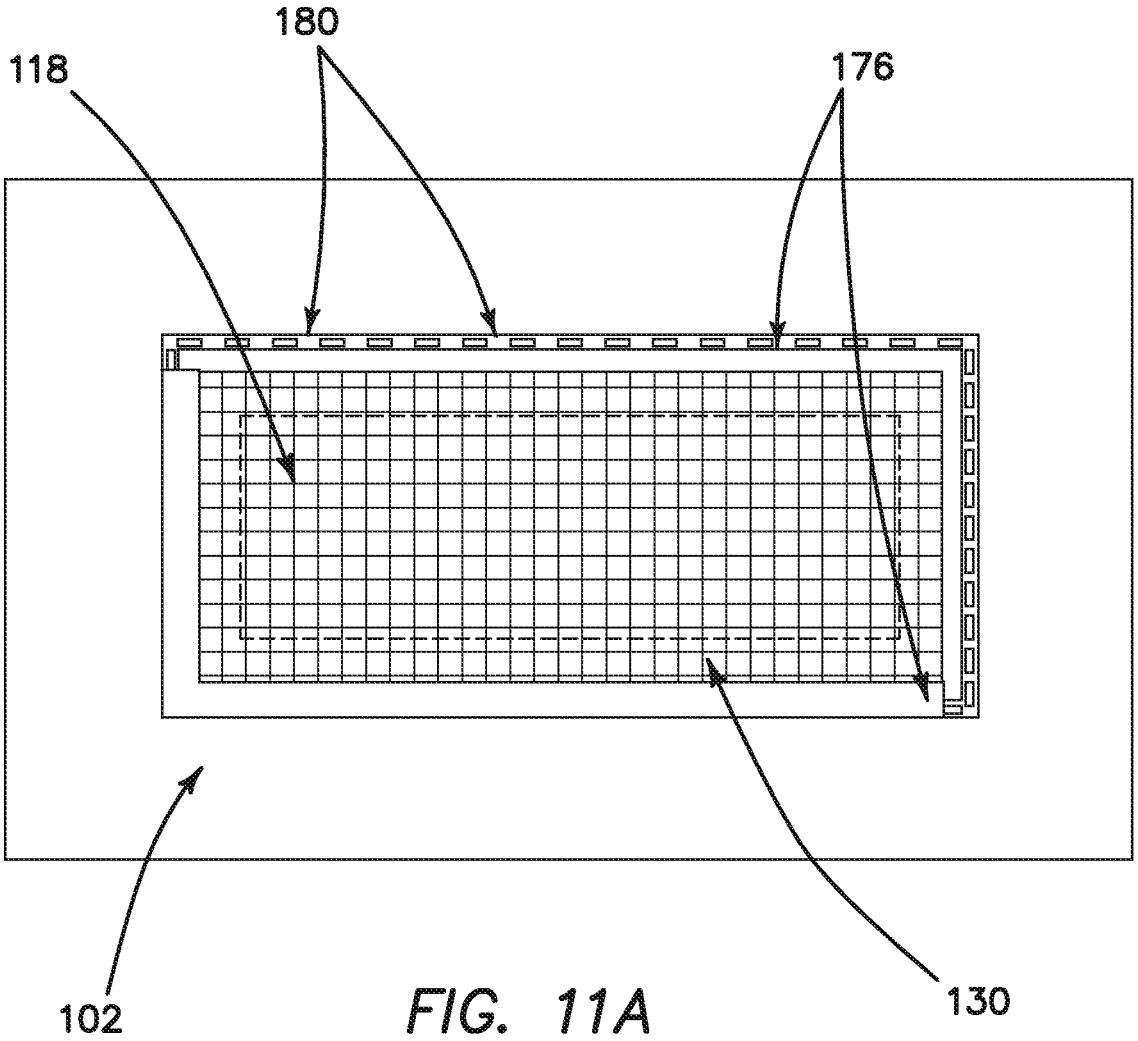
FIG. 11A is is a top view of a filter device of the present invention.

In another example depicted in exploded fashion in FIG. 8, the sediment control device comprises a filter member 130 having a central opening 140 that is smaller than the central opening 104 in the overlying under-seal gasket 102. Filter member 130 may be centrally fastened, very preferable separately fastened, directly to a bottom surface of the under-seal gasket 102 in any appropriate manner; such as by stapling or stitching (as shown in FIG. 10A). The length 126 and width 128 of the threshold member 118 are, very preferably, respectively less than the length 110 and width 112 of the under-seal gasket 102 and greater than the length 114 and width 116 of the opening 104 in the under-seal gasket 102. The threshold member may be centrally, very preferable separately fastened, directly to a top surface of the under-seal gasket 102 in any appropriate manner; such as by stapling or stitching (as shown in FIG. 11A) so as to cover the central opening 104 in the underlying under-seal gasket 102. The threshold member 118 and the filter member 130 are not attached to each other.

In this example an upper skirt 154 may preferably be attached directly to the under-seal gasket 102; however, in some currently less preferred variations of this example the upper skirt may be absent. The upper skirt 154 may be a single, unitary piece having a length and width that are, respectively, smaller than the length 110 and width 112 of the under-seal gasket 102 but larger than the length 114 and width 116 of the opening 104. Alternatively, the upper skirt 154 may include four strips of material 156 that are attached to each other and to the under-seal gasket 102, as depicted in FIGS. 1, 4 and 8. The inward facing edges of the upper skirt 154 may extend over both the under-seal gasket 102 and a portion of the threshold member 118 towards the central opening 104.

Separate berm component 176 comprises a foam insert 152 (in this case, cylindrical in shape) enveloped by a fabric berm sleeve 174. As in other examples, the foam insert 152, circular in this case, may have any desired diameter, depending upon the desired height of the separate berm component 176. In this embodiment the elongated foam cylinder 152 is very preferably between 1 and 2 inches in diameter. In particular, the foam cylinder 152 may preferably be 1.5 inches in diameter. The foam cylinder 152 is formed of a resilient material (e.g., a foamed elastomeric material such as polyurethane, polyethylene, natural latex or the like) that can withstand repeated compression, such as that due to vehicle traffic or high liquid flow rates, without buckling or collapsing. The cylindrical foam insert 152 is covered and enclosed by a tube of material making up the berm sleeve 174. The berm sleeve material may be similar to, or the same as, the material that forms the under-seal gasket 102, and is fastened together by any suitable fastening means; preferably by stitching.

Figure 10B:
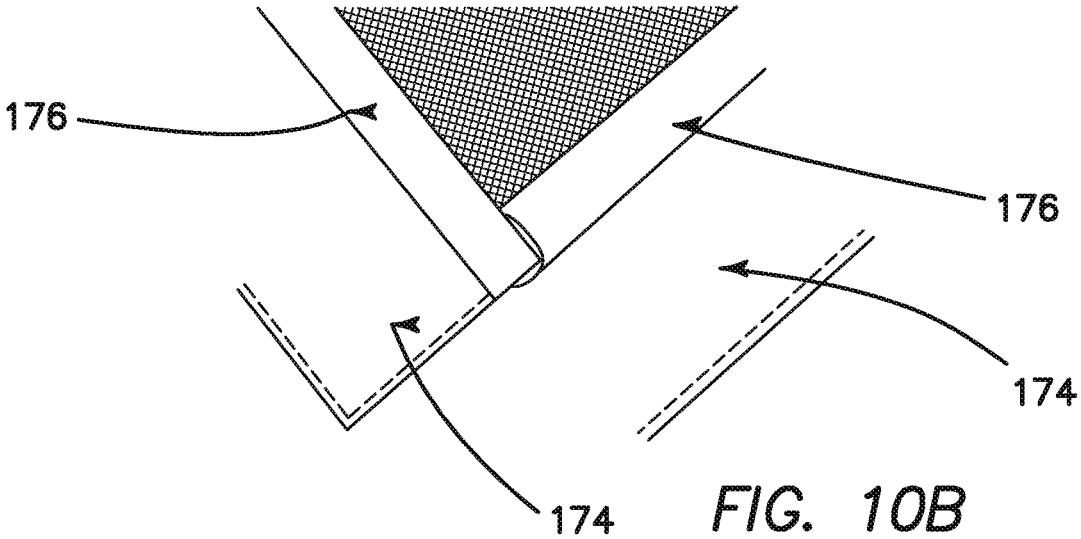
FIG. 10B is a view showing a corner of a top surface of the filter device and separate berm components fastened thereto.

The separate berm component 176 may be a single elongated length of foam 152 wrapped in the berm sleeve 174 which is shaped to extend continuously around part or the entirety of the perimeter of central opening 104. However, in other examples, the separate berm component 176 may comprise a plurality of substantially straight lengths of foam 152 wrapped in the berm sleeve 174 which are directly fastened to the underlying upper skirt 154 or under-seal gasket 102 material. In the example shown in FIG. 8, four lengths of the separate berm component 176 are formed and individually arranged and fastened around the perimeter of central opening 104 to form a dam seal and first line of defense to protect the drain inlet from large amounts of sediment and debris entering the drain. The corners of one such separate berm component 176 arrangement are shown in FIG. 10B.

Figure 9:
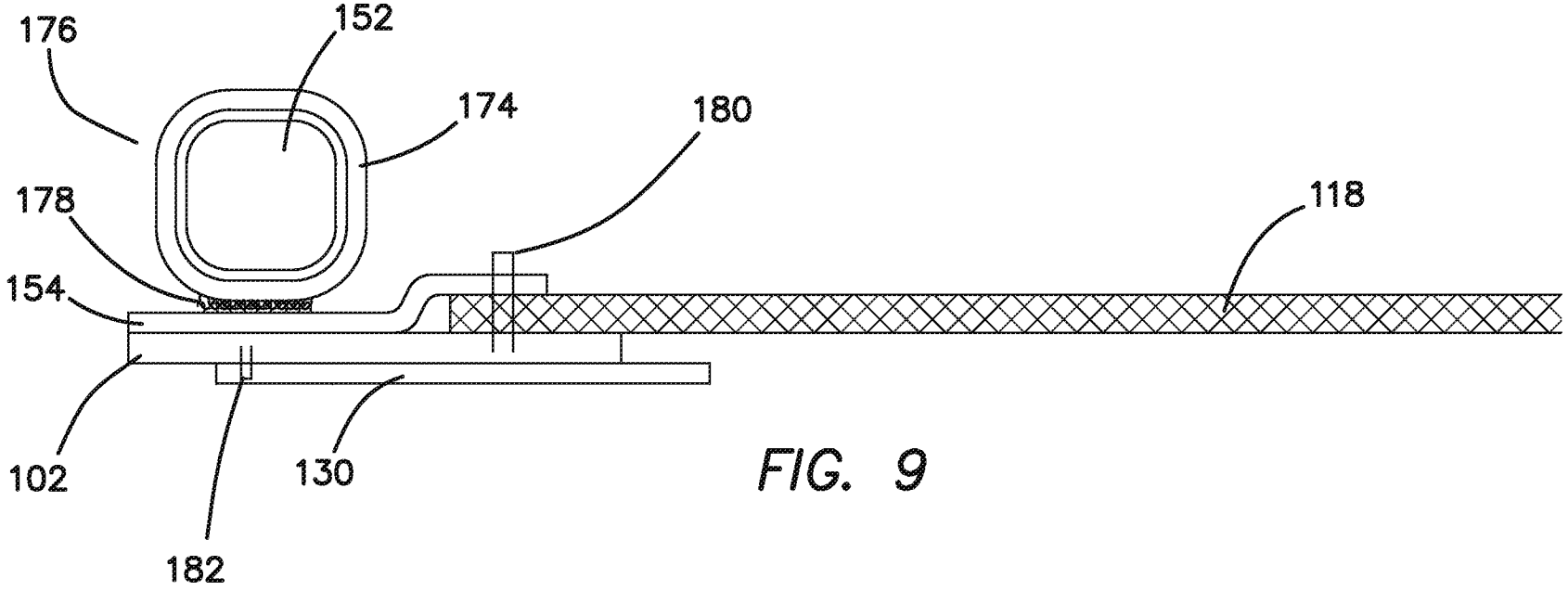
FIG. 9 is a cross-sectional view of the sediment control device and the separate berm component taken along line A-A in FIG. 1 in accordance with another embodiment of the present invention.

As shown in cross-section in FIG. 9, in one example the sediment filter device comprises filter 130 fastened to a bottom surface of the under-seal gasket 102. Although the fastening in this example is accomplished by stitching 182, those of ordinary skill in the art will immediately recognize that alternative fastening methods, such as stapling, heat-sealing and the like may easily be used instead. Apertured threshold member 118 may be fastened directly to both upper skirt 154 and underseal gasket 102 (or directly to under-seal gasket 102; for example, if there is no upper skirt component), preferably by stapling 180.

Separate berm component 176 comprises a foam insert core 152 encased in berm sleeve 174. Hook and loop fasteners 178 are shown as fasteners for removably joining the separate berm component 176 to the material of the upper skirt 154. In other examples lacking an upper skirt 154, the separate berm component may be fastened directly to the under-seal gasket 102. As indicated above, those of ordinary skill in the art will immediately recognize that alternative fastening methods, such as stapling, stitching, heat-sealing and the like may easily be used instead.

FIG. 10A shows a bottom view of the sediment filter device in which the filter member 130 is joined to the under-seal gasket 102 by stitching 182. The apertured threshold member 118 is shown on the opposing side of the device through the central opening of the filter member 130.

FIG. 10B shows a corner of the upper surface of the filter device in which the ends of two lengths of separate berm components 176 meet. The separate berm components are covered with the berm sleeve material 174; the end of one length of the separate berm component 176 is shown extending over the end of a second length of the separate berm component, thus providing an effective seal against intrusion of heavy sediment into the central opening.

FIG. 11A shows the upper surface of the sediment filter device shown in FIG. 10A. Under-seal gasket 102 is depicted having a central opening over which apertured threshold member 118 is fastened directly to the under-seal gasket, in this case by stapling at position 180. Lengths of the separate berm component 176 frame the central opening and hide the staples 180, while the filter member 130 can be seen under the threshold member 118.

Figure 11B:
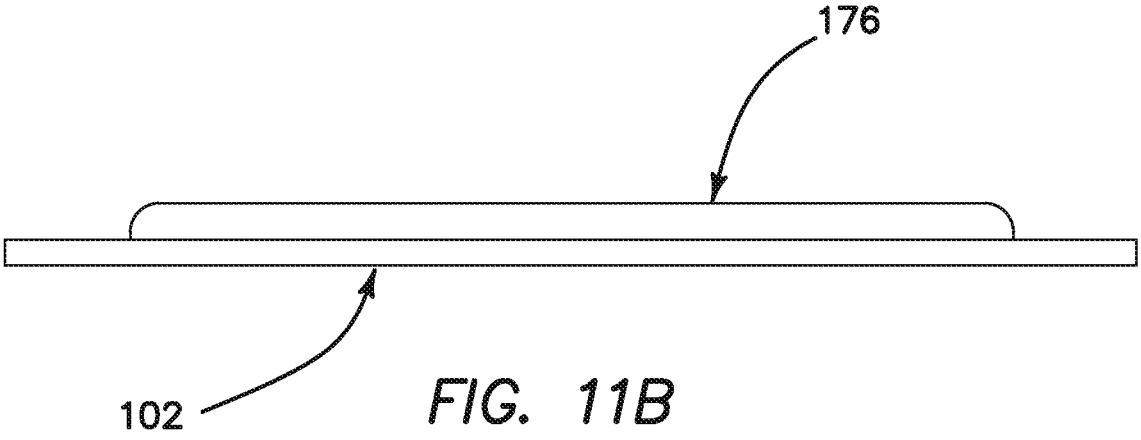
FIG. 11B is a side view of a filter device of the present invention.

FIG. 11B shows a side view of the sediment filter device showing in FIGS. 10A and 11A, wherein the under-seal gasket is show with berm component 176 fastened on top thereof.

Although particular embodiments have been shown and described, it is to be understood that the above description is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims. For example, not all of the components described in the embodiments are necessary, and the invention may include any suitable combinations of the described components, and the general shapes and relative sizes of the components of the invention may be modified. Accordingly, embodiments are intended to exemplify alternatives, modifications, and equivalents that may fall within the scope of the claims. The invention, therefore, should not be limited, except to the following claims, and their equivalents.

What is claimed is:

1. A sediment control device, comprising:

a) an under-seal gasket comprising a top surface, a bottom surface, a first length, and a first width;

b) a first central opening in the under-seal gasket, the first opening having a second length and a second width;

c) a threshold member having a top surface, a bottom surface, a third length, and a third width, wherein i) the threshold member is attached directly to the under-seal gasket, ii) the threshold member extends across the first central opening, and iii) the third length and width are, respectively, greater than the second length and width;

d) a filter member having a top surface, a bottom surface, a fourth length, and a fourth width, wherein i) the top surface of the filter member is attached directly to the bottom surface of the under-seal gasket, and ii) the fourth length and width are, respectively, greater than the second length and width;

e) a second central opening in the filter member, the second opening having a fifth length and a fifth width, wherein i) the fifth length is smaller than the first, second, third, and fourth lengths, and ii) the fifth width is smaller than the first, second, third, and fourth widths; and f) a separate berm component fastened to a top surface of the sediment control device, extending upwards from the top surface of the sediment control device, wherein the separate berm component comprises at least one elongated cylindrical foam member that surrounds a perimeter of the first central opening.

2. The sediment control device of claim 1, wherein the elongated cylindrical foam member is covered with a berm sleeve that is fastened directly to the top surface of the sediment control device.

3. The sediment control device of claim 2, wherein the threshold member comprises outer edges surrounding a central portion that covers the first central opening, and wherein the outer edges of the threshold member are sandwiched between the berm sleeve and the under-seal gasket.

4. The sediment control device of claim 3, wherein the bottom surface of the threshold member is attached directly to the top surface of the under-seal gasket.

5. The sediment control device of claim 1, wherein the under-seal gasket, first central opening, threshold member, filter member, and second central opening are rectangular.

6. The sediment control device of claim 1, wherein the under-seal gasket, first central opening, threshold member, filter member, and second central opening are square.

7. The sediment control device of claim 1, wherein the threshold member comprises a polymeric sheet having apertures.

8. The sediment control device of claim 7, wherein the threshold member is perforated high density polyethylene.

9. The sediment control device of claim 1, wherein the threshold member is a single polymeric sheet comprising a plurality of apertures.

10. The sediment control device of claim 1, wherein the threshold member is a non-laminar polymeric sheet.

11. The sediment control device of claim 1, wherein the top surface of the threshold member is attached directly to the bottom surface of the under-seal gasket.

12. The sediment control device of claim 1, further comprising an additional flap of apertured polymeric material configured for being folded upwards relative to the under-seal gasket and for covering an opening in a curb adjacent to a drain over which the sediment control device is positioned.

13. The sediment control device of claim 1 in which the separate berm component comprises a plurality of substantially straight lengths of elongated cylindrical foam members separately encased in berm sleeves, and arranged to surround the perimeter of the first central opening.

14. A sediment control device, comprising:

a) an under-seal gasket comprising a top surface, a bottom surface, and a first central opening;

b) a threshold member attached directly to the under-seal gasket and extending across the first central opening, the threshold member having a plurality of apertures;

c) a filter member attached directly to the bottom surface of the under-seal gasket and having a second central opening smaller than the first central opening; and d) a separate berm component fastened to and extending upwards from the top surface of the sediment control device, wherein the separate berm component comprises one or more elongated cylindrical foam members that surrounds a perimeter of the first central opening.

15. The sediment control device of claim 14, wherein the cylindrical foam member is enclosed in a berm sleeve, and the berm sleeve is attached directly to the top surface of the under-seal gasket.

16. The sediment control device of claim 15, wherein the threshold member comprises outer edges surrounding a central portion that extends across the first central opening, and wherein the outer edges of the threshold member are sandwiched between the berm sleeve and the under-seal gasket.

17. The sediment control device of claim 16, wherein the threshold member is attached directly to the top surface of the under-seal gasket.

18. The sediment control device of claim 14, wherein a first portion of an upper surface of the filter member is in direct contact with the bottom surface of the under-seal gasket, and wherein a second portion of the upper surface of the filter member is in direct contact with a bottom surface of the threshold member.

19. The sediment control device of claim 14, wherein the threshold member is attached directly to the bottom surface of the under-seal gasket.

20. The sediment control device of claim 14 in which the separate berm component comprises a plurality of substantially straight lengths of elongated cylindrical foam members separately encased in berm sleeves, and arranged to surround the perimeter of the first central opening.

* * * * *